US009623573B1

(12) United States Patent
Windlass et al.

(10) Patent No.: US 9,623,573 B1
(45) Date of Patent: Apr. 18, 2017

(54) CUTLERY BLADE

(71) Applicant: Atlanta Cutlery Corporation, Conyers, GA (US)

(72) Inventors: Pradeep Windlass, Conyers, GA (US); Sudhir Windlass, Conyers, GA (US)

(73) Assignee: Atlanta Cutlery Corporation, Conyers, GA (US)

( * ) Notice: Subject to any disclaimer, the term of this patent is extended or adjusted under 35 U.S.C. 154(b) by 0 days.

(21) Appl. No.: 14/959,629

(22) Filed: Dec. 4, 2015

Related U.S. Application Data

(60) Provisional application No. 62/173,490, filed on Jun. 10, 2015.

(51) Int. Cl.
*B26B 11/00* (2006.01)
*B26B 25/00* (2006.01)
*B26B 9/00* (2006.01)

(52) U.S. Cl.
CPC ..... *B26B 11/006* (2013.01); *B26B 9/00* (2013.01); *B26B 25/005* (2013.01)

(58) Field of Classification Search
CPC ..... B26B 11/006; B26B 25/005; B26B 9/00
USPC ..... 30/299
See application file for complete search history.

(56) References Cited

U.S. PATENT DOCUMENTS 226,146 A * 3/1880 Zimmerer ..... B26B 5/00 30/299
RE9,335 E * 8/1880 Offineer ..... 30/299
342,957 A * 6/1886 Gaines ..... B26B 5/00 30/299
3,895,442 A * 7/1975 Langford ..... B26B 9/00 30/299
4,096,629 A * 6/1978 Levine ..... B26B 1/00 30/152
4,606,125 A * 8/1986 Jensen ..... F41B 15/00 30/151
8,037,612 B2 * 10/2011 Hansen ..... B26B 3/00 30/165
8,555,514 B2 * 10/2013 Jensen ..... F41B 15/00 30/152
2010/0236077 A1 * 9/2010 Shirey ..... B26B 1/02 30/152
2010/0287779 A1 * 11/2010 Wilson ..... B26B 9/00 30/122
2016/0354937 A1 * 12/2016 Matthews ..... B26B 5/00

* cited by examiner

*Primary Examiner* — Hwei C Payer
(74) *Attorney, Agent, or Firm* — Walter A. Rodgers

(57) ABSTRACT

A cutlery blade having a longitudinal slot formed therein and having spaced longitudinal rails to receive one or more rotating blade assemblies. A handle is attached to the blade and a pair of tabs are integrally formed in the longitudinal slot in proximity to the handle and one of the rotating blade assemblies is in locking engagement with the tabs.

7 Claims, 3 Drawing Sheets

CUTLERY BLADE

The benefits under 35 USC 119 are claimed of provisional patent application 62/173,490 filed Jun. 10, 2015.

BACKGROUND OF THE INVENTION

Cutlery utensils are used in a wide variety of applications such as typical kitchen and utility knives as well as tactical knives and swords used as weapons. Knives and like implements usually include a flat blade with one or both edges sharpened which makes the blade an effective cutting and slashing tool. The functioning of the knife blade is enhanced by the addition of serrations and the like. Typical straight-edged blades are useful for slicing and chopping and rotating blades are often used for cutting pizza and perforating baked items such as pie crusts. In a combat context, knife and sword blades are intended to do internal damage to an opponent.

BRIEF SUMMARY OF THE INVENTION

A dual purpose cutlery implement having a handle with an elongated generally planar blade affixed thereto. A longitudinal slot is formed in the blade and has a longitudinal rail integral with each side edge of the slot and extending substantially the length of the slot. A rotating blade assembly including a rotary blade with an aperture formed in the middle thereof and with an axle extending through the aperture. A pair of side brackets are secured respectively to the outer ends of the axle and a pair of notches are formed in the brackets remote from the rotary blade. The longitudinal rails are slidably disposed in the bracket notches to allow the rotating blade assembly to slide along the rails within the longitudinal slot.

DETAILED DESCRIPTION OF THE INVENTION

Figure 1:
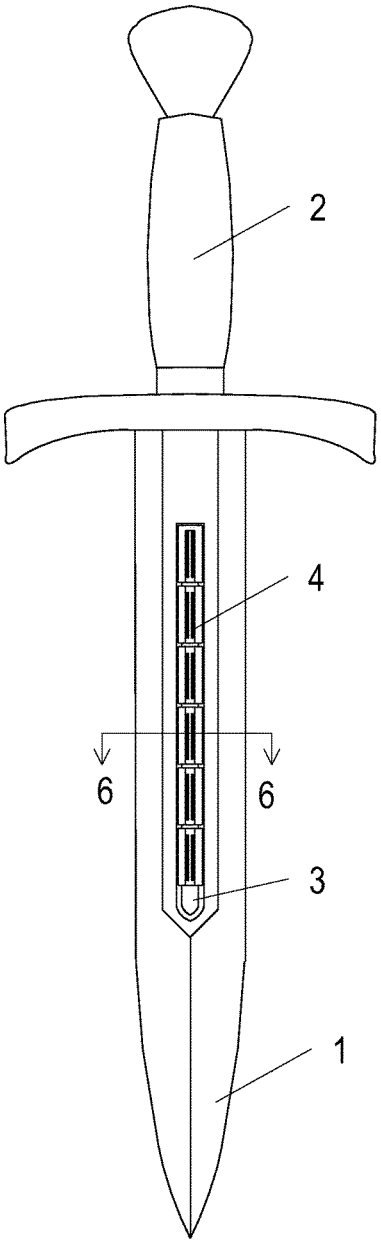
FIG. 1 is a plan view of a cutlery blade in the form of a sword, according to this invention.

In the drawings, a sword is shown although this invention is equally adaptable for use in connection with other implements such as knives, daggers, axes and the like. As best shown in FIG. 1, blade 1 is suitably attached to handle 2 in known manner.

Figure 5:
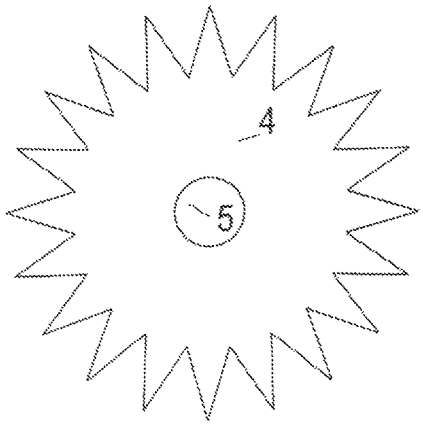
FIG. 5 is an enlarged plan view of the rotatable blade.

According to this invention, longitudinal slot 3 is formed in blade 1 with rotating blades 4 mounted therein. Rotating blades 4 are shown in detail in FIG. 5 in the form of a circular star wheel design, although other suitable designs are well within the scope of this invention. Rotating blade 4 is provided with center aperture 5.

As shown in the drawings, a pair of matching rotating blades 4 are disposed in a side by side disposition with axle 6 extending through apertures 5 of both rotating blades 4 and with the two blades separated by means of spacer 7 coaxially mounted on axle 6. Longitudinal slot 3 is provided with spaced longitudinal rails 8 which are integral, respectively, with the side edges of longitudinal slot 3 and extend substantially the entire length thereof.

Figure 6:
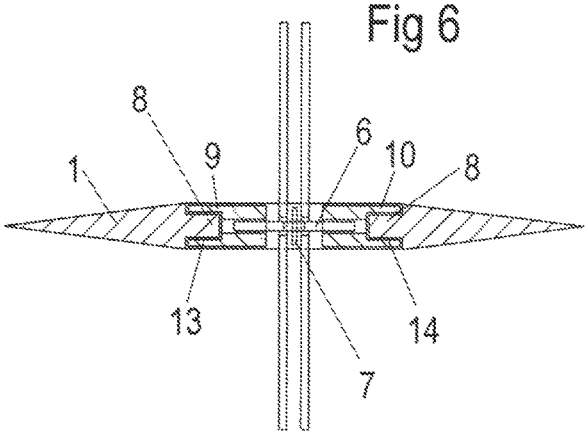
FIG. 6 is a cross-sectional view taken along the line 6-6 in FIG. 1.

Each pair of rotary blades 4 is provided with side brackets 9 and 10 to form a rotating blade assembly. Side brackets 9 and 10 are provided with openings 11 and 12, respectively, which are adapted to receive the exposed outer ends of axle 6. As best shown in FIG. 6, notches 13 and 14 are formed along the outer side edges, respectively, of side brackets 9 and 10 remote from openings 11 and 12. In accordance with this invention, notches 13 and 14 are adapted to slidably receive longitudinal rails 8 of longitudinal slot 3.

In order to complete the cutlery blade assembly, according to this invention, and to allow for the mounting of multiple rotating blade assemblies on rails 8, cutouts 15 and 16 are formed in longitudinal rails 8 at the upper end of blade 1 closest to handle 2. In order to secure the rotating blade assemblies in longitudinal slot 3, the rotary blade assembly positioned closest to handle 2 is provided with a pair of attachment brackets 17 and 18. Each attachment bracket 17 and 18 includes rectangular notch 19 and semicircular notch 20. A pair of tabs 21 and 22 are integrally formed on the side edges of longitudinal slot 3, respectively, opposite rails 8 and in proximity to handle 2.

In order to assemble the cutlery blade, according to this invention, initially spacer 7 is mounted on axle 6 with a pair of rotating blades 4 mounted on axle 6, respectively, on opposite sides of spacer 7. Following this, side brackets 9 and 10 are pressed onto the rotating blade assembly by the insertion of the exposed outer ends of axle 6 into openings 11 and 12 of side brackets 9 and 10, respectively. The rotating blade assembly is then placed within cutouts 15 and 16 and moved downwardly longitudinally of blade 1 whereby side brackets 9 and 10 are slidably maneuvered along the knife blade by means of longitudinal rails 8 disposed within notches 13 and 14. In the same manner, additional rotating rail assemblies are mounted within longitudinal slot 3 of blade 1.

By omitting spacer 7 and mounting a single rotating blade 4 on axle 6, double blade assemblies can be alternated with single blade assemblies whereby a single blade is interleaved between a double rail assembly so that the assemblies can be positioned closer together.

Figure 7:
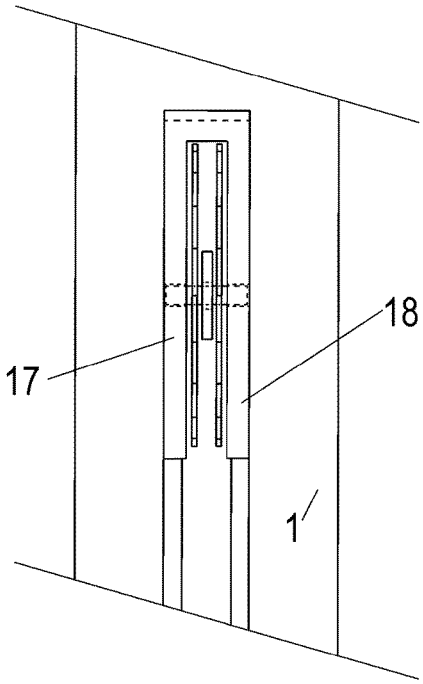
FIG. 7 is an enlarged partial view showing details of the invention.
Figure 9:
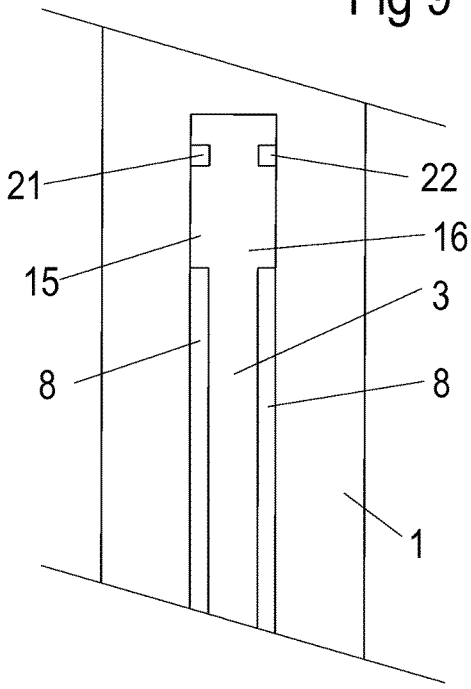
FIG. 9 is an enlarged partial view showing the blade with the rotating blade assemblies removed.
Figure 8:
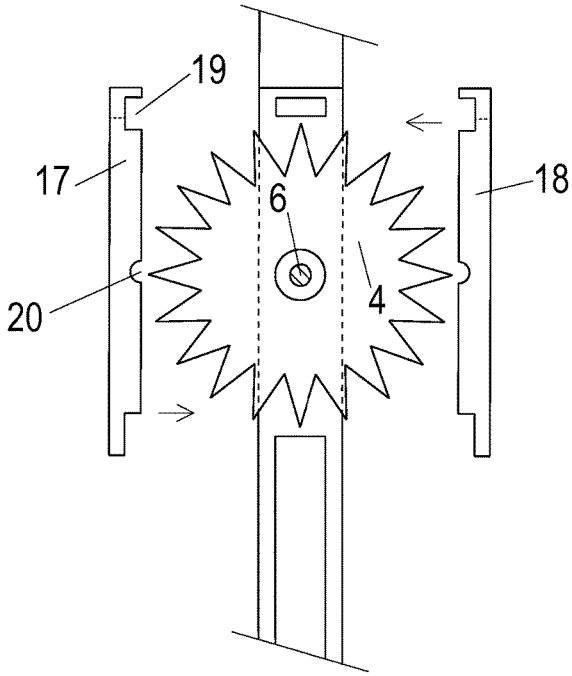
FIG. 8 is an enlarged exploded view depicting assembly of the rotatable blades.

In order to secure the rotating blade assemblies on blade 1, the rotating blade assembly shown in FIGS. 6 and 7 is employed. More specifically, attachment brackets 17 and 18 are positioned on opposite sides of rotating blade 4 which in turn is positioned between cutouts 15 and 16 of longitudinal slot 3. Attachment brackets 17 and 18 are then pressed together whereby axle 6 is positioned within semicircular notches 20 of each attachment bracket 17 and 18 and, simultaneously, rectangular notches 19 are positioned in a frictional interconnection respectively with tabs 21 and 22.

Figure 2:
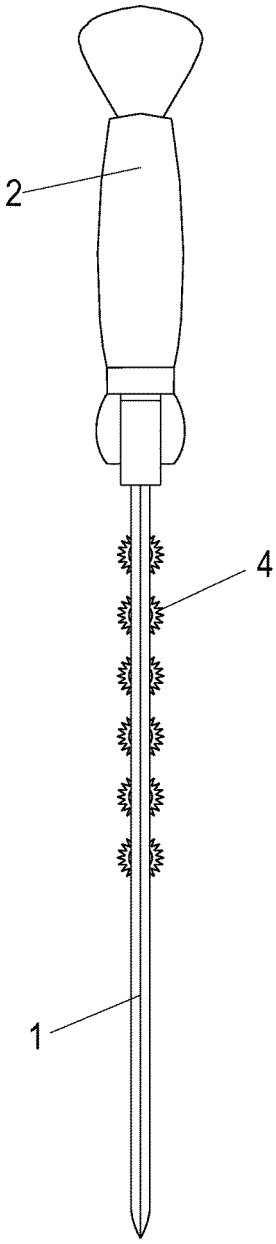
FIG. 2 is a plan view of the sword rotated 90 degrees from that shown in FIG. 1.
Figure 3:
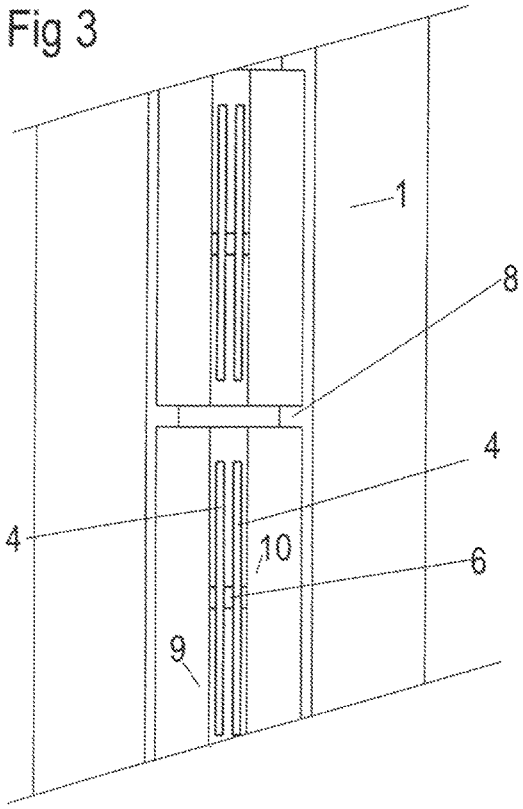
FIGS. 3 and 4 are enlarged partial views showing details of the rotatable blade feature of this invention.
Figure 4:
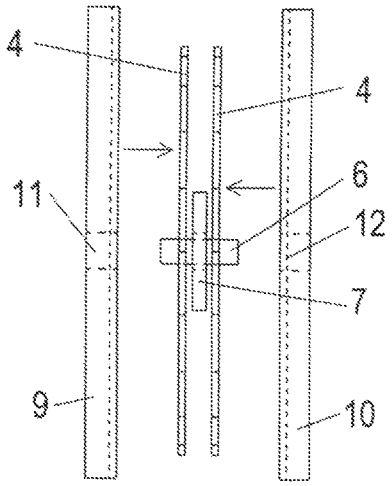

The fully assembled cutlery blade, according to this invention, is shown in FIGS. 1 and 2. The number of rotating blade assemblies positioned within longitudinal slot 3 can be varied, as desired, by simply separating attachment brackets 17 and 18 disposed at the proximate end of blade 1 and removing the blade assemblies or positioning additional assemblies on longitudinal rails 8.

Therefore, by this invention, a dual-purpose knife is used in a conventional manner such as for kitchen use by using the sharpened knife blade edge or edges for food cutting purposes. In the alternative, the blade is rotatable 90 degrees whereby the rotating cutters are utilized, in one context, for cutting difficult to cut food items. In a combat environment, the knife or sword is used to penetrate an opponent whereby the rotatable cutters inflict maximum damage when thrust in and pulled out of an adversary's body. The rotating cutters produce a wide puncture area and do not catch on soft tissue but roll off bones allowing maximum damage without being caught in the wound or clothing.

The invention claimed is:

1. A cutlery blade comprising a longitudinal slot formed in the blade, said slot having spaced side edges, a pair of longitudinal rails formed respectively on said edges and extending substantially the length of said slot, at least one rotating blade, an aperture formed in said rotating blade, an axle extending through said aperture and having outer ends, a pair of side brackets engaging respectively said outer ends, a pair of notches formed respectively in said side brackets, and said notches slidably disposed on said rails.

2. The cutlery blade according to claim 1 wherein a spacer is positioned on said axle and said at least one rotating blade comprises a pair of rotating blades disposed on said axle respectively on opposite sides of said spacer.

3. The cutlery blade according to claim 1 wherein said rotating blade is circular.

4. A cutlery blade comprising a longitudinal slot formed in the blade, said slot having spaced side edges, a pair of longitudinal rails formed respectively on said edges and extending substantially the length of said slot, a rotating blade, an aperture formed in said rotating blade, an axle extending through said aperture and having outer ends, and a pair of attachment brackets disposed perpendicularly to said rotating blade and in engagement with said outer ends.

5. An implement comprising a cutlery blade according to claim 4 and a handle secured to said cutlery blade at one end thereof and wherein cutouts are formed respectively in said rails in proximity to said handle.

6. The implement according to claim 5 wherein a pair of tabs are formed respectively on said side edges adjacent said cutouts.

7. The implement according to claim 6 wherein said attachment brackets respectively comprise notches and said notches are in frictional engagement respectively with said tabs.

* * * * *